US008554102B2

(12) United States Patent
Ishikawa

(10) Patent No.: US 8,554,102 B2
(45) Date of Patent: Oct. 8, 2013

(54) DEVELOPING DEVICE AND IMAGE FORMING APPARATUS

(75) Inventor: Masaru Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 191 days.

(21) Appl. No.: 13/247,384

(22) Filed: Sep. 28, 2011

(65) Prior Publication Data

US 2012/0251155 A1 Oct. 4, 2012

(30) Foreign Application Priority Data

Mar. 28, 2011 (JP) ..... 2011-069696

(51) Int. Cl.
*G03G 21/20* (2006.01)

(52) U.S. Cl.
USPC ..... 399/92

(58) Field of Classification Search
USPC ..... 399/92, 222
See application file for complete search history.

(56) References Cited

U.S. PATENT DOCUMENTS

| | | | | |
|---|---|---|---|---|
| 4,361,396 | A * | 11/1982 | Uchida | 399/92 |
| 7,546,058 | B2 * | 6/2009 | Katoh et al. | 399/92 |
| 2004/0223779 | A1 * | 11/2004 | Satoh | 399/98 |
| 2008/0112723 | A1 * | 5/2008 | Oguma et al. | 399/104 |
| 2011/0217065 | A1 * | 9/2011 | Kusakabe | 399/92 |

FOREIGN PATENT DOCUMENTS

JP A-6-110306 4/1994

* cited by examiner

*Primary Examiner* — G. M. Hyder
(74) *Attorney, Agent, or Firm* — Oliff & Berridge, PLC

(57) ABSTRACT

A developing device includes a development roller that holds developer containing toner and carrier, rotates and transports the developer to a development area, and develops a latent image using the toner; a housing that has a first opening that opens towards the image holding member, and that holds the development roller; an airflow path that has a second opening that opens towards the image holding member at a location below the first opening; a blower that causes air in the airflow path to be sent in a direction in which the toner scattered between the housing and the image holding member is sucked from the second opening; and a magnetic plate opposing an end portion of the development roller in a direction of an axis of rotation of the development roller and extending so as to surround the development roller in a direction of rotation of the development roller.

9 Claims, 12 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2011-069696 filed Mar. 28, 2011.

BACKGROUND (i) Technical Field

The present invention relates to a developing device and an image forming apparatus.

SUMMARY

According to an aspect of the invention, there is provided a developing device including a development roller that holds developer containing toner and carrier, rotates and transports the developer to a development area, and develops a latent image using the toner, the development area opposing an image holding member that holds the latent image; a housing that has a first opening that opens towards the image holding member, wherein the housing holds the development roller so that the development area of the development roller is exposed from the first opening, the housing containing the developer therein; an airflow path that has a second opening that opens towards the image holding member at a location below the first opening; a blower that causes air in the airflow path to be sent in a direction in which the toner scattered between the housing and the image holding member is sucked from the second opening; and a magnetic plate that is disposed in the housing, the magnetic plate opposing an end portion of the development roller in a direction of an axis of rotation of the development roller and extending so as to surround the development roller in a direction of rotation of the development roller. The housing has a suction hole. The suction hole is formed between an edge of the magnetic plate at a side of a lower edge of the first opening and the lower edge of the first opening. The suction hole is connected to the airflow path. The suction hole sucks the developer that has leaked out from the housing into the airflow path.

BRIEF DESCRIPTION OF THE DRAWINGS

An exemplary embodiment of the present invention will be described in detail based on the following figures, wherein.

DETAILED DESCRIPTION

An exemplary embodiment of the present invention will hereunder be described.

Figure 1:
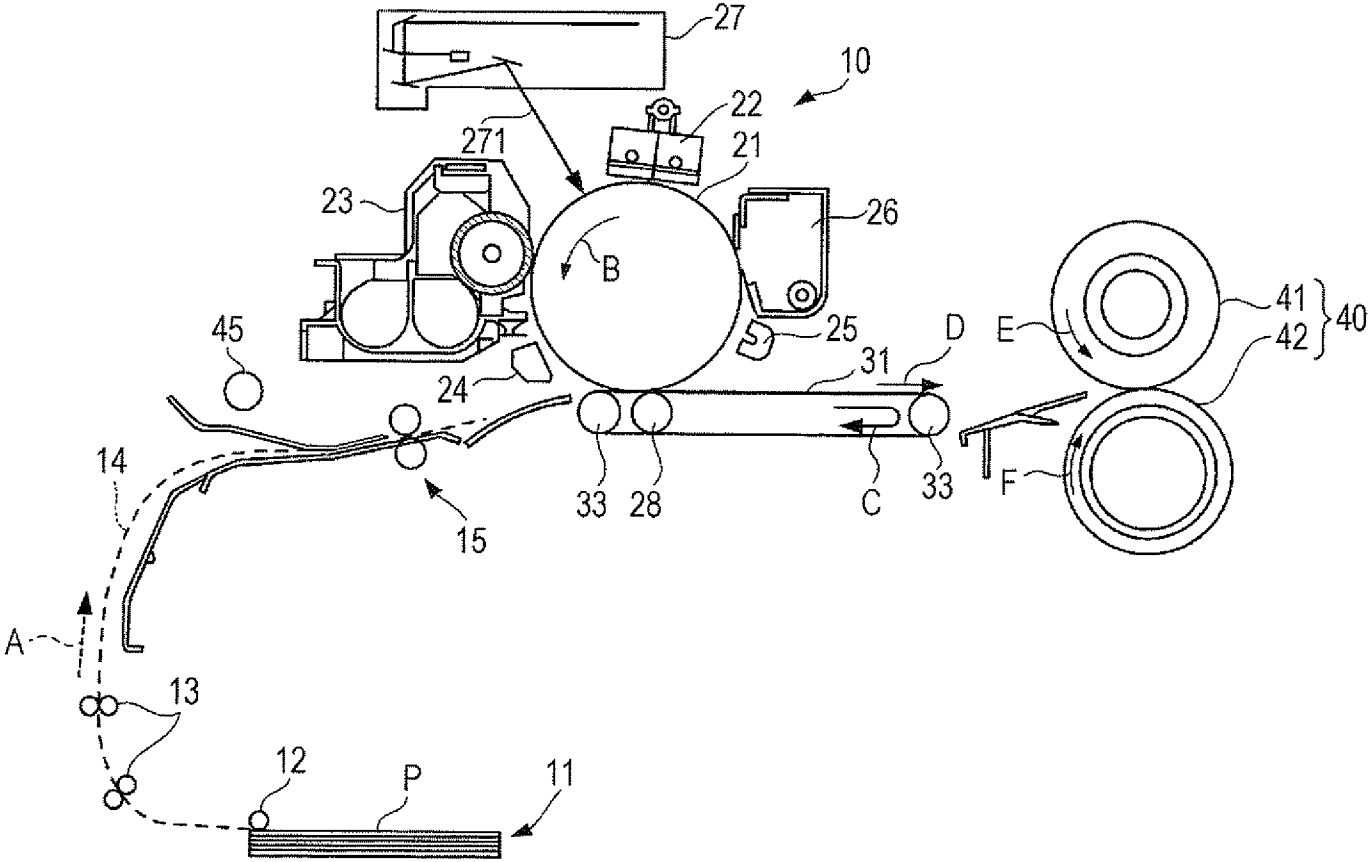
FIG. 1 is a schematic view of a structure of an image forming apparatus according to an exemplary embodiment of the present invention.

FIG. 1 is a schematic view of a structure of an image forming apparatus 10 according to an exemplary embodiment of the present invention.

A sheet-feed table 11 shown at a lower portion of FIG. 1 holds sheets P that are stacked upon each other. In forming images, the sheets P are sent out one at a time by a send-out roller 12 from the sheet-feed table 11, and are transported along a transport path 14 in the direction of arrow A by transport rollers 13. Then, transport timings of subsequent transportations of the sheets P are adjusted by standby rollers 15, to further transport the sheets P. The subsequent transportations beyond the standby rollers 15 will be described below.

As shown in a central portion of FIG. 1, the image forming apparatus 10 includes a photoconductor member 21 that rotates in the direction of arrow B. The photoconductor member 21 is an exemplary image holding member in the present invention. A charging unit 22, a developing unit 23, an auxiliary transfer unit 24, an electricity removing unit 25, and a cleaner 26 are disposed around the photoconductor member 21. An exposure unit 27 is disposed above the photoconductor member 21. A transfer roller 28 is placed at a location where a transfer belt 31 (described below) is interposed between the photoconductor member 21 and the transfer roller 28.

The photoconductor member 21 has a cylindrical shape. The photoconductor member 21 is electrically charged by charging, and releases an electric charge by exposure, to hold an electrostatic latent image on its surface.

The charging unit 22 charges the surface of the photoconductor member 21 to a certain charging potential by electric discharge.

An image signal is input to the exposure unit 27, so that the exposure unit 27 outputs an optical beam 271 modulated in accordance with the input image signal. The exposure unit 27 repeatedly causes the optical beam 271 to scan a portion of the surface of the photoconductor member 21 charged by the charging unit 22 in a direction of an axis of rotation of the photoconductor member 21, to form an electrostatic latent image on the surface of the photoconductor member 21. The photoconductor member 21 rotates in the direction of arrow B. The direction of the axis of rotation of the photoconductor member 21 corresponds to a direction perpendicular to the plane of FIG. 1.

After the electrostatic latent image is formed on the surface of the photoconductor member 21 when the surface of the photoconductor member 21 is scanned with the optical beam 271, the electrostatic latent image is developed by the developing unit 23, so that a toner image is formed on the surface of the photoconductor member 21. The developing unit 23 corresponds to an exemplary developing device in the present invention. The developing unit 23 will be described later in detail.

Electric charge of the toner image formed on the photoconductor member 21 by the developing operation by the developing unit 23 is adjusted by the auxiliary transfer unit 24. Then, the toner image reaches a transfer position where the transfer unit 28 is disposed. A sheet P is sent out from the standby rollers 15 so that the sheet P also reaches the transfer position at a timing in which the toner image on the photoconductor member 21 reaches the transfer position. The toner image on the photoconductor 21 is transferred to the sheet P by the action of the transfer unit 21 at the transfer position. After the transfer, the electric charge on the photoconductor member 21 is removed by the electricity removing unit 25. Then, any toner remaining on the photoconductor member 21 after the transfer is removed by the cleaner 26.

The sheet P to which the toner image is transferred from the photoconductor member 21 is placed on the endless transfer belt 31 that is placed on two rollers 33 and that circulates in the direction of arrow C, and is transported in the direction of arrow D. Then, the sheet P is heated and pressed by a fixing unit 40, so that the toner image is fixed to the sheet P. The fixing unit 40 includes a heating roller 41 that rotates in the direction of arrow E and a pressure roller 42 that rotates in the direction of arrow F. The sheet P that has passed through the fixing unit 40 is further transported, and is discharged to the outside of the image forming apparatus.

The image forming apparatus 10 also includes a blower 45. The blower 45 is connected to an air duct (not shown in FIG. 1). The blower 45 sucks, along with air, toner that has leaked out from the developing unit 23 and that has been scattered, products that have been generated by the electric discharge, etc., and cleans the air by a filter to discharge the air out of the image forming apparatus 10. The products generated by the electric discharge are by-products of the electric discharge at the charging unit 22.

Figure 2:
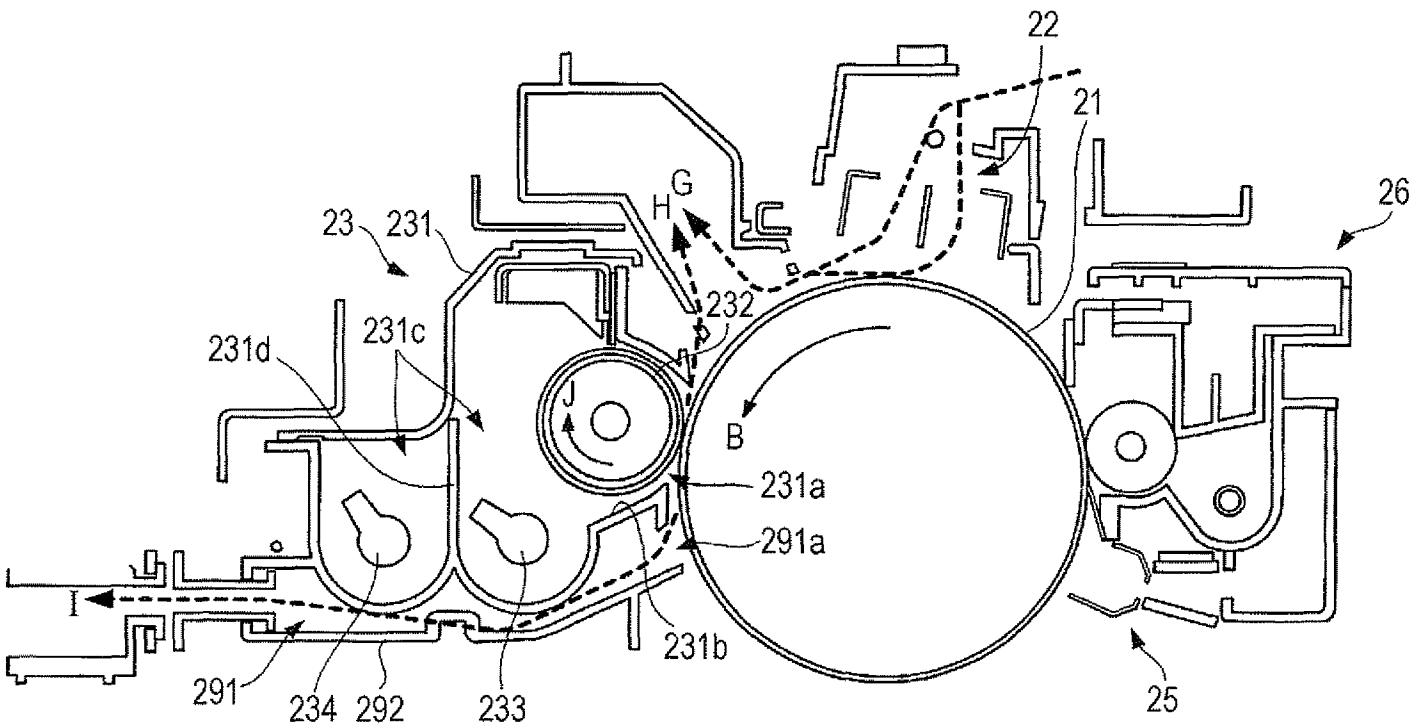
FIG. 2 shows a structure of the image forming apparatus shown in FIG. 1 in the vicinity of a photoconductor member, and flows of air.

FIG. 2 shows a structure of the image forming apparatus shown in FIG. 1 in the vicinity of the photoconductor member, and flows of air.

As mentioned above, the charging unit 22, the developing unit 23, the electricity removing unit 25, the cleaner 26, etc. are disposed around the photoconductor member 21. Although, as shown in FIG. 1, the auxiliary transfer unit 24, the transfer belt 31, etc. are also disposed around the photoconductor member 21, they are not shown in FIG. 2.

When the blower 45 shown in FIG. 1 sucks air, air flows in the directions of arrows G, H, and I in the vicinity of the photoconductor member 21. Any products generated by the electric discharge at the charging unit 22 are collected by the flow of air along the direction of arrow G. Any toner that starts to scatter upward from the developing unit 23 is collected by the flow of air along the direction of arrow H. Any toner that starts to scatter downward from the developing unit 23 is collected by the flow of air along the direction of arrow I. One of the focuses of attention in the exemplary embodiment is the flow of air along the arrow I.

A structure of the developing unit 23 related to the flow of air in the direction of arrow I will hereunder be described.

The developing unit 23 includes a housing 231 and a development roller 232. In the housing 231, a developer containing toner and a carrier is contained in two developer containing chambers 231*c* that are divided by a dividing plate 231*d*. The two developer containing chambers 231*c* are connected to each other at respective end portions provided in a direction perpendicular to the plane of FIG. 2. Augers 233 and 234 are disposed in the respective developer containing chambers 231*c*. The developer in the two developer containing chambers 231*c* circulates in a direction perpendicular to the plane of FIG. 2 while being stirred by the two augers 233 and 234.

The housing 231 has a first opening 231*a* that opens towards the photoconductor member 21. The housing 231 rotatably holds the development roller 232 with an area of the development roller 232 opposing the photoconductor member 21 being exposed from the first opening 231*a*.

The development roller 232 holds the developer in the housing 231 on its surface, and rotates in the direction of arrow J, to transport the developer to a development area of the development roller 232 opposing the photoconductor member 21 that holds the electrostatic latent image (formed by scanning the photoconductor member 21 with the optical beam 271 from the exposure unit 27 shown in FIG. 1), so that the electrostatic latent image is developed with the toner. The housing 231 of the developing unit 23 includes an inclined surface 231*b* that extends obliquely downward towards an inner portion of the housing 231 from a lower edge of the first opening 231*a* while the inclined surface opposes the development roller 232.

An air duct plate 292 is disposed below the housing 231. The air duct plate 292 forms an air duct 291 along which air flows along the direction of arrow 1 between a lower surface of the housing 231 and the air duct plate 292. The air duct 291 has a second opening 291*a*. The second opening 291*a* opens towards the photoconductor member 21 at a location below the first opening 231*a* of the housing 231 where the development roller 232 is exposed. The second opening 291*a* is an inlet for allowing air to flow into the air duct 291. When the air flows into the air duct 291 from the second opening 291*a*, any toner scattered between the housing 231 and the photoconductor member 21 is sucked from the second opening 291*a* along with the air.

The developing unit 23 will be further described in detail below.

Figure 3:
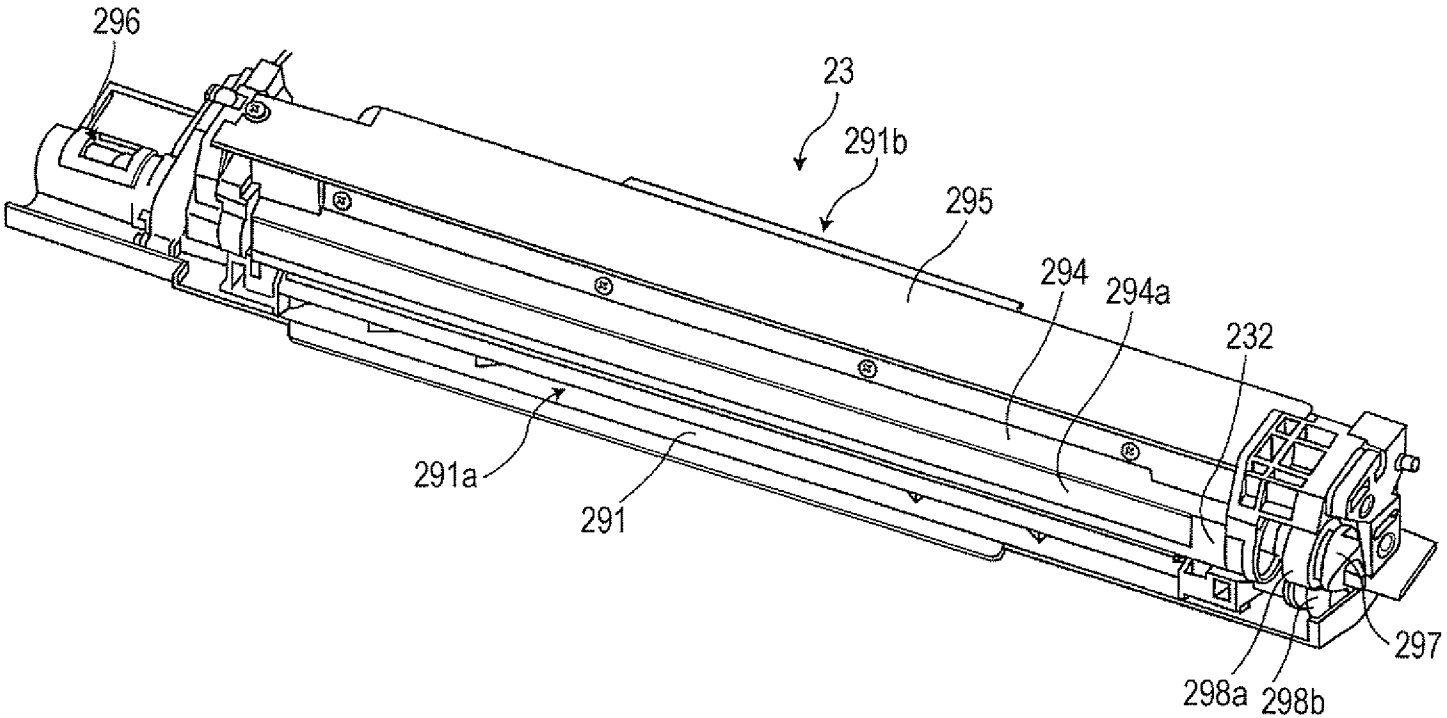
FIG. 3 is an external perspective view of a developing unit as viewed obliquely from above the developing unit.
Figure 4:
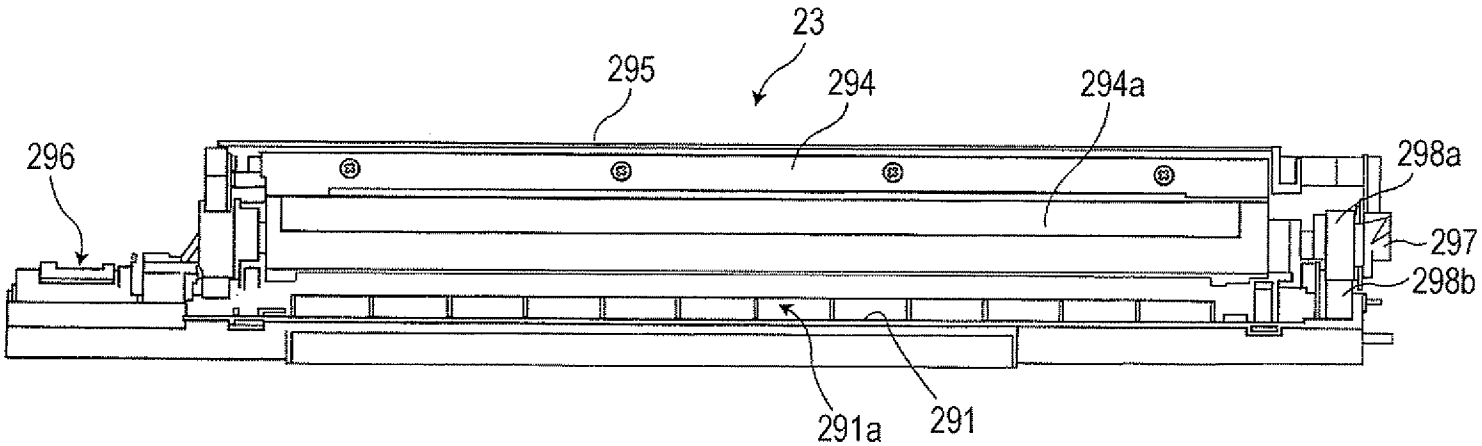
FIG. 4 is a front view of the developing unit.

FIG. 3 is an external perspective view of the developing unit as viewed obliquely from above the developing unit. FIG. 4 is a front view of the developing unit.

The developing unit 23 has the second opening 291*a*, where the inlet allows air to flow into the air duct 291 (see FIG. 2), at the lower portion thereof, with the development roller 232 being visible above the second opening 291*a*. FIG. 3 also shows an outlet 291*b* for the air that has flown into the air duct 291 from the second opening 291*a*. The outlet 291*b* is connected to an air duct that extends further from this portion. A portion of the development roller 232 is covered with a film seal 294*a*. The film seal 294*a* is a seal member for suppressing scattering of the toner of the developer in the developing unit. The film seal 294*a* is secured to a seal securing member 294. The seal securing member 294 is screwed to the housing of the developing unit 23. A cover member 295 is disposed at an upper surface of the developing unit 23.

As mentioned above, since the toner of the developer in the developing unit is used for developing the electrostatic latent image on the photoconductor member 21, the developing unit is replenished with toner. In FIG. 3, a toner receiving opening 296 that receives replenishing toner from a toner cartridge (not shown) that contains the replenishing toner is visible. A coupling 297 is provided at a side opposite to the toner receiving opening 296 so as to be coaxial with the development roller 232. The coupling 297 receives rotational driving force from a motor (not shown) that is provided at an apparatus body. The rotational driving force is transmitted to the coupling 297 from the motor (not shown), to rotate the development roller 232. A gear 298*a* is provided adjacent to the coupling 297 so as to be coaxial with the coupling 297. Another gear 298*b* engages the gear 298*a*. The gear 298*b* is coaxially provided at the auger 233 among the two augers 233 and 234 (see FIG. 2). The gear 298*b* engages a gear that is hidden in the developing unit 23 and that is provided coaxially with the auger 234. Therefore, the rotational driving force that is transmitted to the coupling 297 is also transmitted to the two augers 233 and 234. As a result, these augers 233 and 234 rotate to circulate the developer in the developing unit while stirring the developer.

Figure 5:
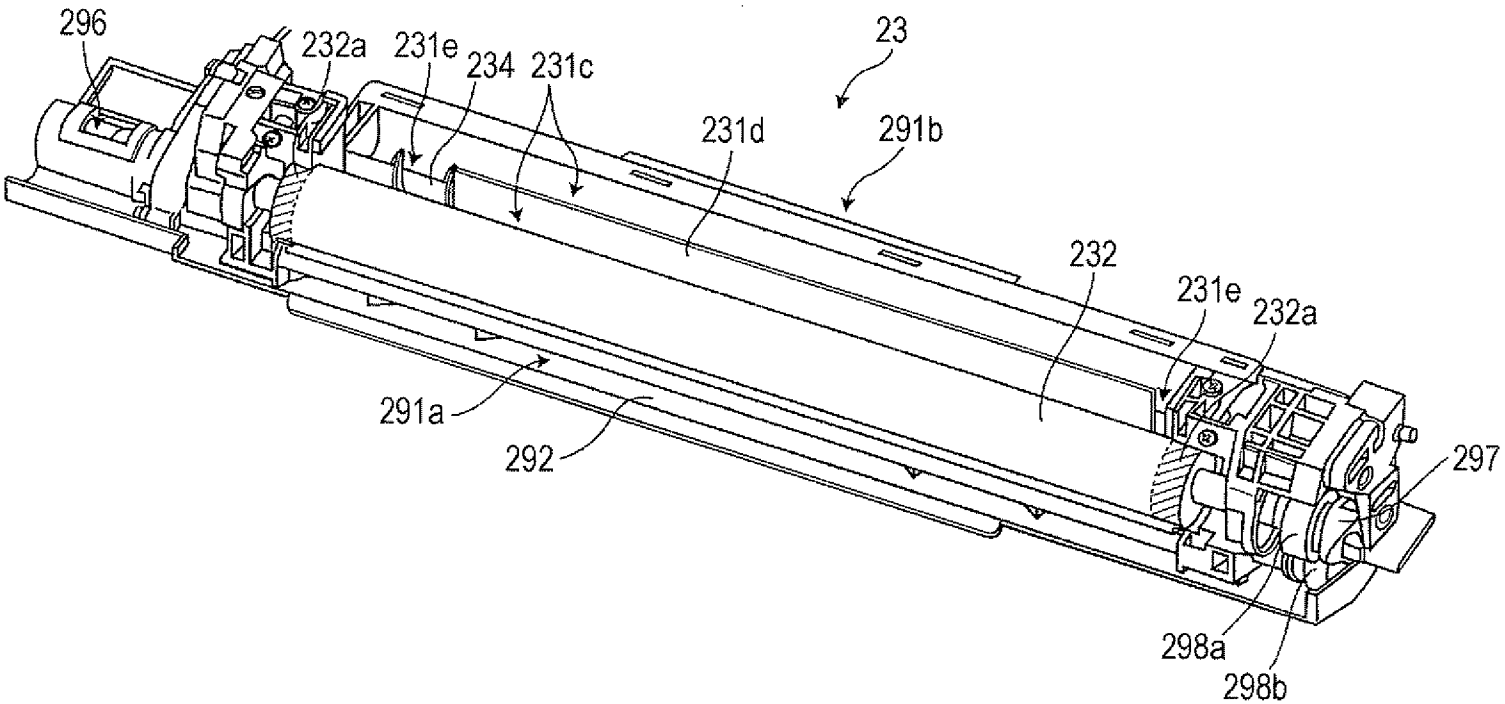
FIG. 5 is a perspective view of a development roller, etc., after removing a cover member, etc., from the developing unit, the developing unit being obliquely viewed from above the developing unit.
Figure 6:
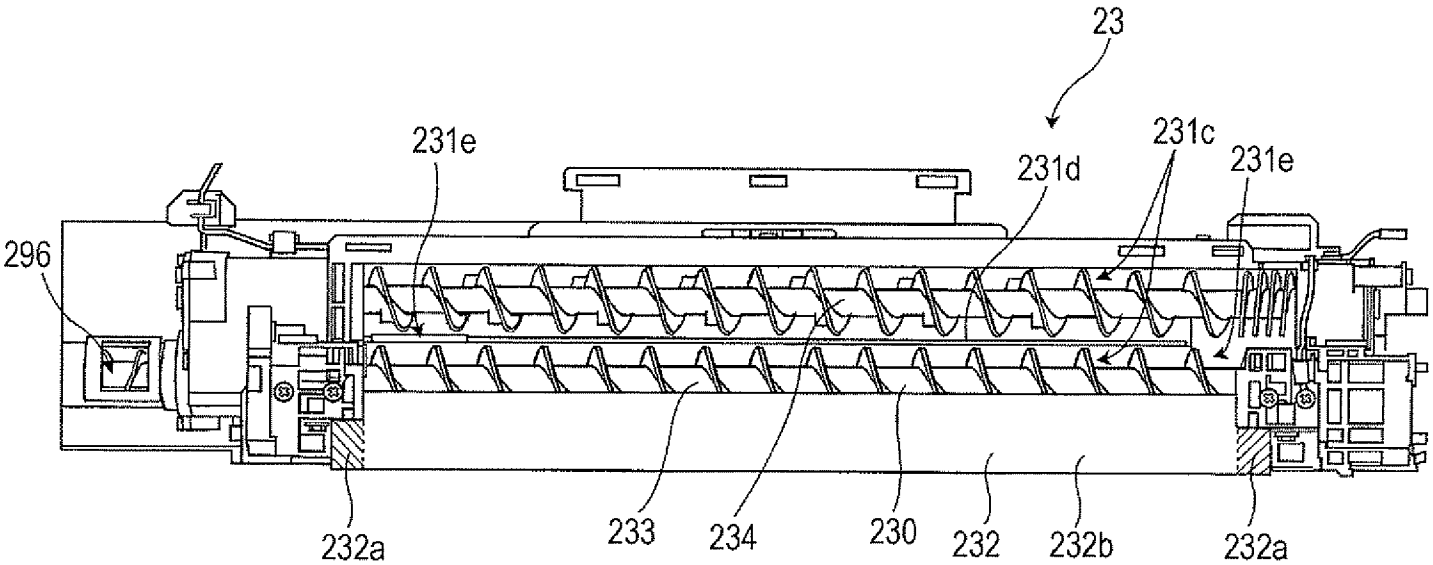
FIG. 6 is a plan view of the development roller, etc., after removing the cover member, etc., from the developing unit.

FIG. 5 is a perspective view of the development roller, etc., after removing the cover member, etc., from the developing unit, the developing unit being obliquely viewed from above the developing unit. FIG. 6 is a plan view of the development roller, etc., after removing the cover member, etc., from the developing unit.

The plan view of FIG. 6 shows the two augers 233 and 234. In FIG. 5, the auger 233 adjacent to the development roller 232 among the two augers 233 and 234 is hidden by the development roller 232, and the auger 234 alone is shown. However, a large portion of the auger 234 is hidden by the dividing plate 231*d* that divides the two developer containing chamber 231*c*. Paths 231*e* that connect the two developer containing chambers 231*c* to each other are provided on respective sides of the dividing plate 231*d* in a longitudinal direction. The development roller 232 has non-development areas 232*a* on respective end portions of the development roller 232 in a direction of an axis of rotation thereof. The non-development areas 232*a* do not hold the developer contained in the housing of the developing unit, and do not contribute to the development of the electrostatic latent image on the photoconductor member 21 (not shown). A central portion of the development roller 232, which is a portion other than the non-development areas 232*a* at the respective end portions of the development roller 232, corresponds to a development area 232*b* that holds the developer and that is used to develop the electrostatic latent image.

Figure 7:
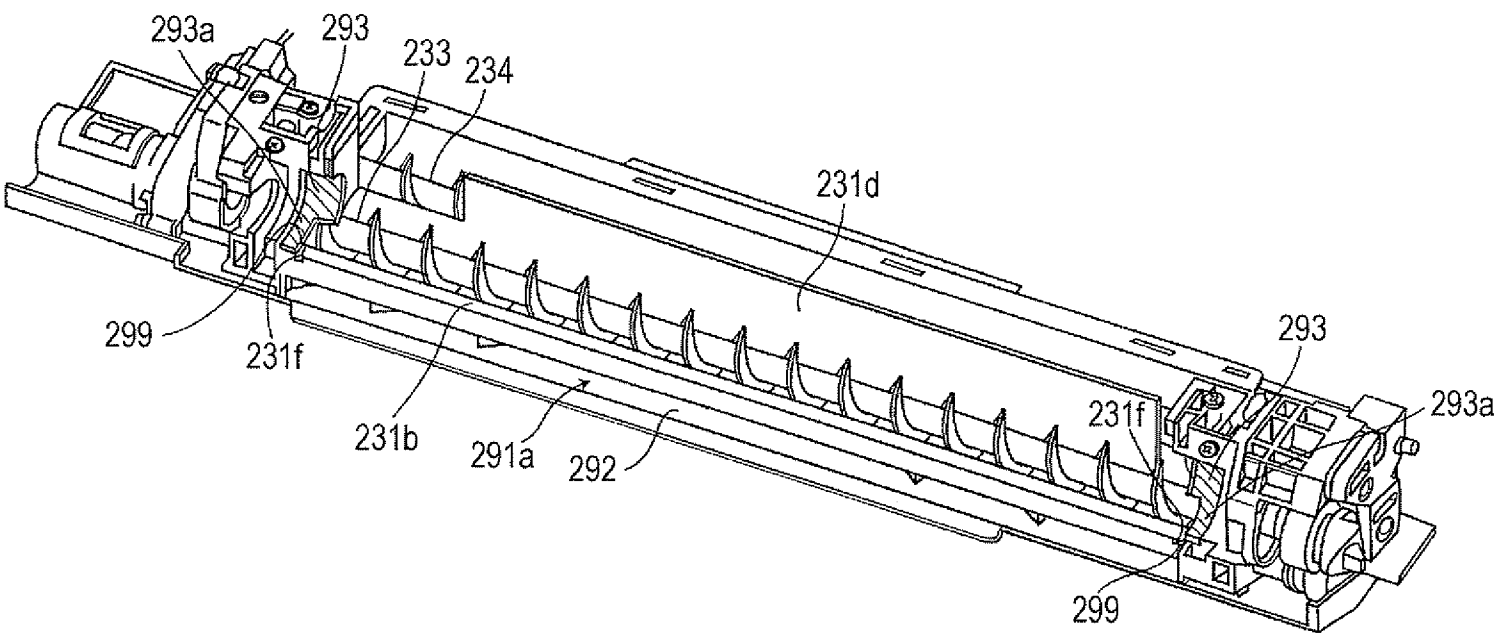
FIG. 7 is a perspective view showing a state in which the development roller is removed from the developing unit in the state shown in FIGS. 5 and 6.
Figure 8:
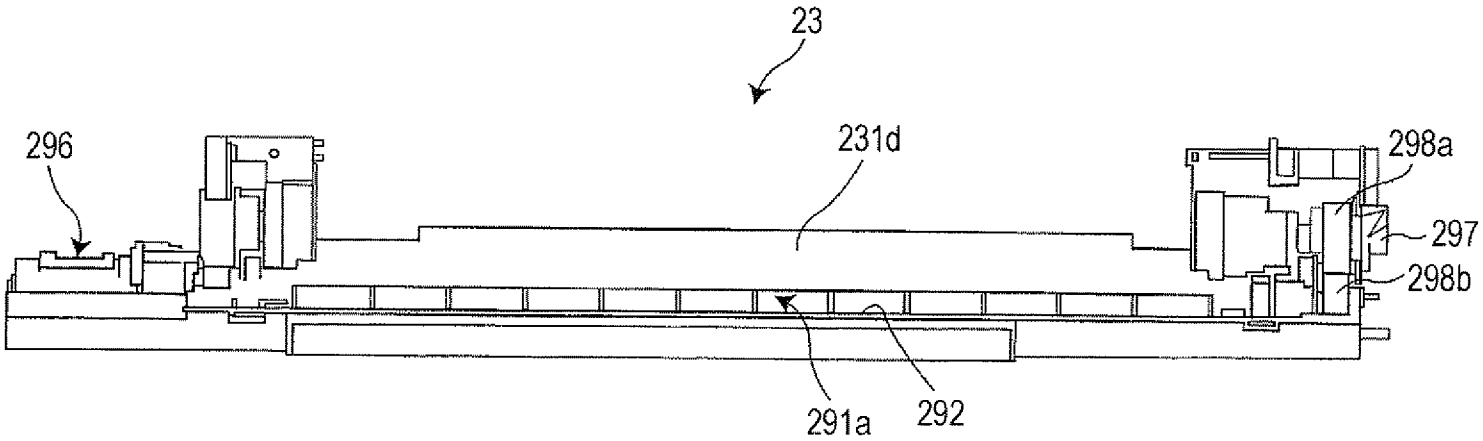
FIG. 8 is a front view showing the state in which the development roller is removed from the developing unit in the state shown in FIGS. 5 and 6.
Figure 9:
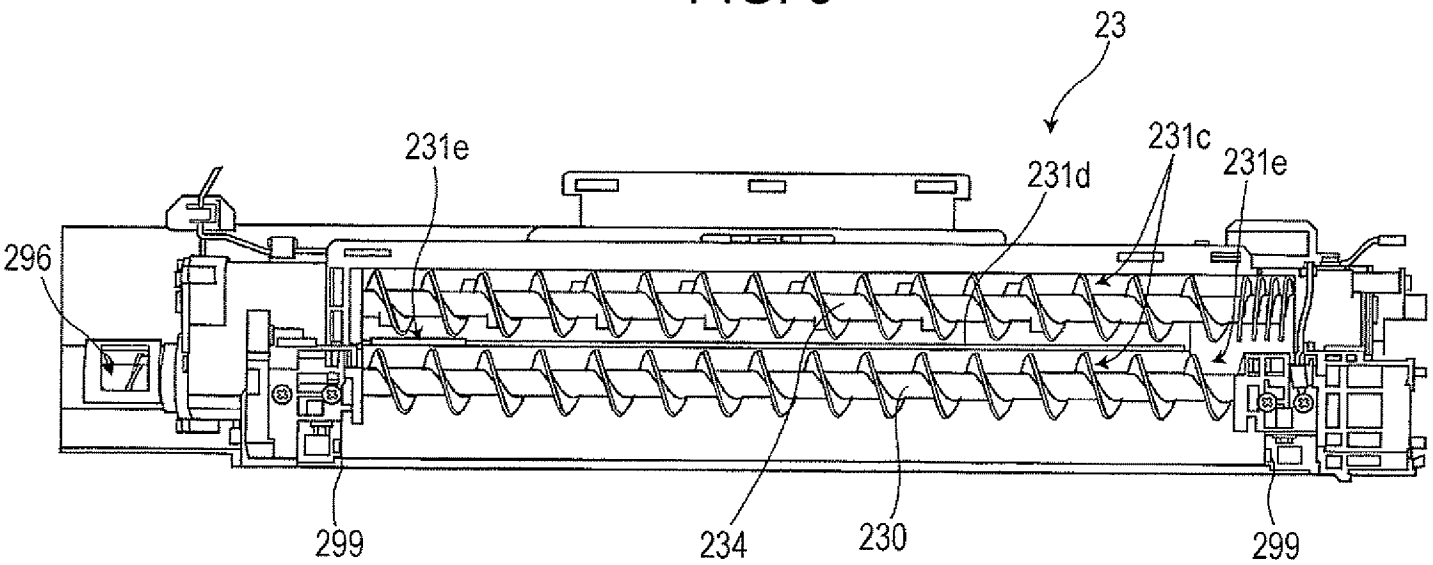
FIG. 9 is a plan view showing the state in which the development roller is removed from the developing unit in the state shown in FIGS. 5 and 6.

FIG. 7 is a perspective view showing a state in which the development roller is removed from the developing unit in the state shown in FIGS. 5 and 6. FIG. 8 is a front view showing the state in which the development roller is removed from the developing unit in the state shown in FIGS. 5 and 6. FIG. 9 is a plan view showing the state in which the development roller is removed from the developing unit in the state shown in FIGS. 5 and 6.

Figure 10:
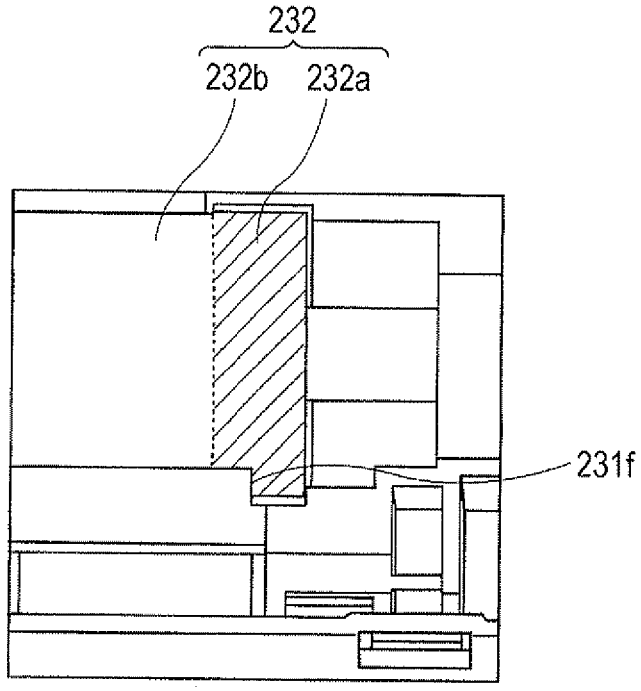
FIG. 10 is a front view of a right corner of the development roller after removing the cover member, etc., from the developing unit as in FIGS. 5 and 6.
Figure 11:
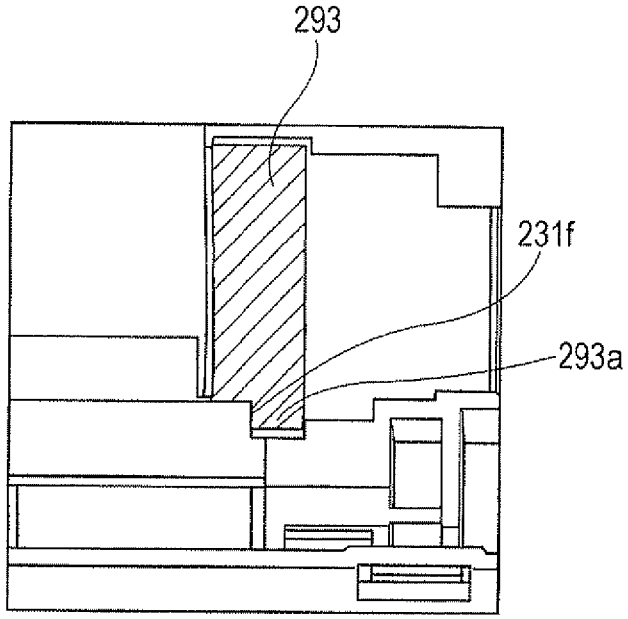
FIG. 11 is a front view of a right corner of the developing unit from which the development roller is removed.

FIG. 10 is a front view of a right corner of the development roller, etc. after removing the cover member, etc., from the developing unit as in FIGS. 5 and 6. FIG. 11 is a front view of a right corner of the developing unit from which the development roller is removed.

Figure 12:
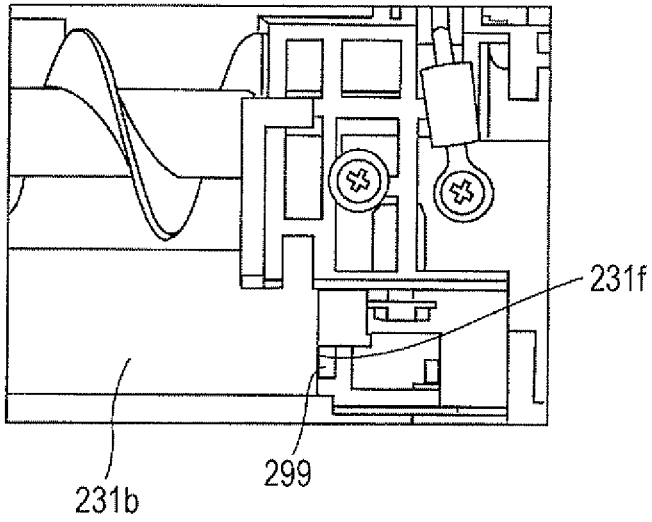
FIG. 12 is a plan view of the right corner of the developing unit from which the development roller is removed.
Figure 13:
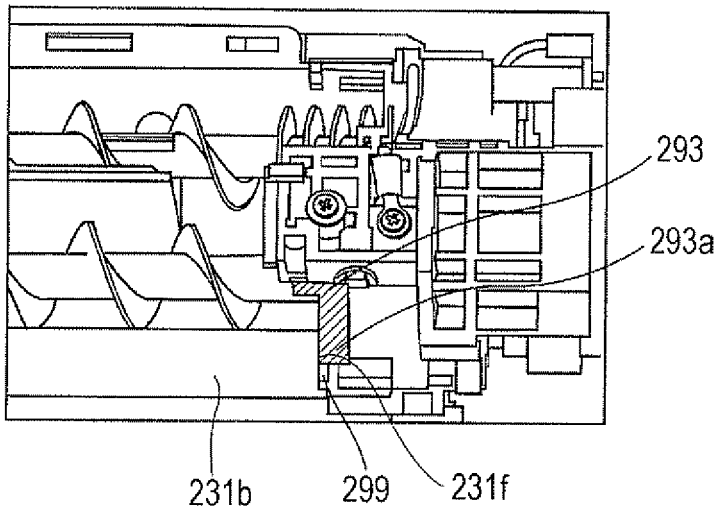
FIG. 13 shows the right corner of the developing unit from which the development roller is removed, as viewed obliquely from a slightly forward position.

FIG. 12 is a plan view of the right corner of the developing unit from which the development roller is removed as in FIGS. 7 to 9 and FIG. 11. FIG. 13 shows the right corner of the developing unit from which the development roller is removed, as in FIGS. 7 to 9 and FIGS. 11 and 12. However, FIG. 13 shows the right corner of the developing unit from which the development roller is removed as viewed obliquely from a slightly forward position, rather than from directly above the developing unit.

As shown in FIG. 7, etc., the inclined surface 231*b* shown in FIG. 2 is formed in the housing of the developing unit. The inclined surface 231*b* extends obliquely downward towards the inner portion of the housing 231 from the lower edge of the first opening 231*a* with the inclined surface 231*b* opposing the development roller 232 (see FIGS. 2, 5, and 6). The inclined surface 231*b* terminates at wall surfaces 231*f* that extend substantially vertically downward so as to oppose the respective end portions of the development roller in a longitudinal direction (that is, the direction of the axis of rotation of the development roller 232).

Magnetic plates 293 are disposed at the developing unit 23 in correspondence with the end portions of the axis of rotation of the development roller in the housing (see FIGS. 7, 10, and 11). These magnetic plates 293 surround the development roller in a direction of rotation thereof, and suppresses leakage of the developer in the direction of the axis of rotation by magnetically attracting the carrier in the developer contained in the housing.

The development roller 232 has the non-development areas 232*a* (see FIGS. 5 and 6) at the end portions of the development roller 232 in the direction of the axis of rotation of the development roller 232. Of the non-development areas 232*a* at the respective end portions of the development roller 232, FIG. 10 shows the non-development area at the right end portion. As mentioned above, these non-development areas 232*a* do not hold the developer contained in the housing of the developing unit, and do not contribute to the development of the electrostatic latent image on the photoconductor member (see FIG. 1).

The magnetic plates 293 shown in FIGS. 7, 10, and 11 extend so as to oppose the non-development areas 232*a* (see FIGS. 5, 6, and 10) at the respective end portions of the development roller 232 in the direction of the axis of rotation thereof, and stop the developer from leaking out at these positions.

Each magnetic plate 293 has an area 293*a* having a narrow width. Each area 293*a* is provided towards the low edge of the first opening 231*a* (see FIG. 2) of the housing of the developing unit in the direction of rotation of the development roller 232. Each area 293*a* has a relatively narrow shape in the direction of the axis of rotation of the development roller 23. The narrow shape of each area 293*a* is formed by leaving a portion of each magnetic plate 293 situated towards the corresponding end of the development roller 232, and by cutting a portion of each magnetic plate 293 situated towards the center of the development roller 232.

Each area 293*a* is separated from the development area 232*b* (see FIGS. 6 and 10) of the development roller 232 in the direction of the axis of rotation of the development roller 232 by a distance corresponding to the cut amount. This reduces a force that magnetically attracts the developer contained in the developing unit. The narrow areas 293*a* of the respective magnetic plates 293 are situated just outside the walls surfaces 231*f* (see FIGS. 7, 11, and 13) at the inclined surface 231*b*. The developer that leaks out from the inside of the developing unit towards the areas 293*a* is caused to flow downward along the inclined surface 231*b*, and is returned to the inside of the developing unit.

Suction holes 299 are provided in the housing of the developing unit so as to be situated at positions adjacent to the magnetic plates 293 (see FIGS. 7, 12, and 13). The suction holes 299 are connected to the air duct 291 (see FIG. 2), and are formed between edges of the magnetic plates 293 at a side of the lower edge of the first opening 231*a* (see FIG. 2) and the lower edge of the first opening 231*a*. The suction holes 299 are formed at the outer sides of the wall surfaces 231*f* at the respective ends of the inclined surface 231*b* so as to be situated adjacent to the wall surfaces 231*f* in the direction of the axis of rotation of the development roller 232. When the air in the air duct 291 is pulled in the direction of arrow I shown in FIG. 2, the developer that has overflowed from the inside of the developing unit without being collected into the developing unit along the inclined surface 231*b* is sucked into the suction holes 299, and is collected through the air duct 291.

In the exemplary embodiment, the scattering of the developer that has leaked out from both end portions of the development roller is suppressed by forming the suction holes 299.

Figure 14:
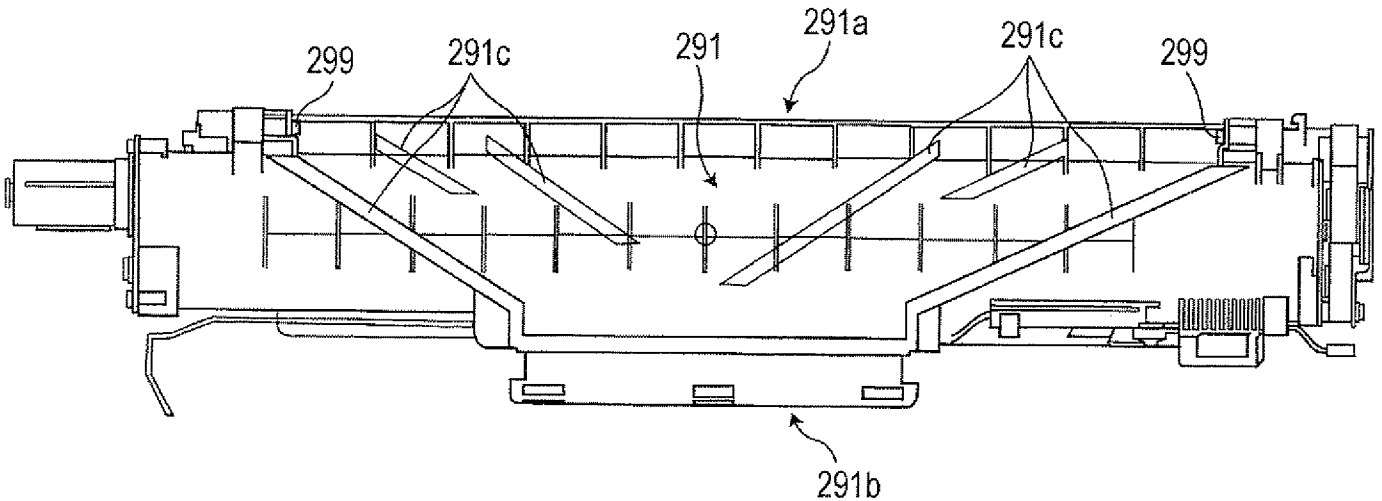
FIG. 14 is a bottom view of a lower surface of a housing of the developing unit.

FIG. 14 is a bottom view of the lower surface of the housing of the developing unit.

FIG. 14 shows the lower surface of the housing after removal of the air duct plate 292 (see, for example, FIGS. 2 and 3), with the lower surface of the housing forming the air duct 291 along with the air duct plate 292.

Urethane guide walls 291*c* are provided at the lower surface of the housing. The guide walls 291*c* guide air flowing towards the outlet 291*b* from the second opening 291*a* so that the air flows uniformly from the relatively wide second opening 291*a* (see FIG. 2). FIG. 14 also shows openings of the suction holes 299 at the side of the air duct 291.

Here, although the image forming apparatus having the structure shown in FIG. 1 is described as an example, the present invention is applicable to an electrophotographic image forming apparatus that forms, for example, color images.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a development roller that holds developer containing toner and carrier, rotates and transports the developer to a development area, and develops a latent image using the toner, the development area opposing an image holding member that holds the latent image;

a housing that has a first opening that opens towards the image holding member, wherein the housing holds the development roller so that the development area of the development roller is exposed from the first opening, the housing containing the developer therein;

an airflow path that has a second opening that opens towards the image holding member at a location below the first opening;

a blower that causes air in the airflow path to be sent in a direction in which the toner scattered between the housing and the image holding member is sucked from the second opening; and a magnetic plate that is disposed in the housing, the magnetic plate opposing an end portion of the development roller in a direction of an axis of rotation of the development roller and extending so as to surround the development roller in a direction of rotation of the development roller, wherein the housing has a suction hole, the suction hole being formed between an edge of the magnetic plate at a side of a lower edge of the first opening and the lower edge of the first opening, the suction hole being connected to the airflow path, the suction hole sucking the developer that has leaked out from the housing into the airflow path.

2. The developing device according to claim 1, wherein the housing has an inclined surface that extends obliquely downward towards an inner portion of the housing from the lower edge of the first opening with the inclined surface opposing the development roller, the inclined surface terminating at a wall surface that extends substantially vertically downward so as to oppose the end portion of the development roller in the direction of the axis of rotation of the development roller, and wherein the suction hole is formed at an outer side of the wall surface so as to be situated adjacent to the wall surface in the direction of the axis of rotation of the development roller.

3. The developing device according to claim 2, wherein a portion of the magnetic plate situated towards the lower edge of the first opening in the direction of rotation of the development roller has a shape having a narrower-width potion that has a narrower width than a portion other than the narrower-width portion compared in the direction of the axis of rotation of the development roller, the narrower shape being formed by leaving a portion of the magnetic plate situated towards the end portion of the development roller in the direction of the axis of rotation of the development roller, and by cutting a portion of the magnetic plate situated towards a center of the development roller.

4. The developing device according to claim 3, wherein the development roller has a non-development area at the end portion of the development roller in the direction of the axis of rotation of the development roller, the non-development area not contributing to the development of the latent image on the image holding member, and wherein the magnetic plate extends so as to oppose the non-development area.

5. The developing device according to claim 2, wherein the development roller has a non-development area at the end portion of the development roller in the direction of the axis of rotation of the development roller, the non-development area not contributing to the development of the latent image on the image holding member, and wherein the magnetic plate extends so as to oppose the non-development area.

6. The developing device according to claim 1, wherein a portion of the magnetic plate situated towards the lower edge of the first opening in the direction of rotation of the development roller has a shape having a narrower-width potion that has a narrower width than a portion other than the narrower-width portion compared in the direction of the axis of rotation of the development roller, the narrower shape being formed by leaving a portion of the magnetic plate situated towards the end portion of the development roller in the direction of the axis of rotation of the development roller, and by cutting a portion of the magnetic plate situated towards a center of the development roller.

7. The developing device according to claim 6, wherein the development roller has a non-development area at the end portion of the development roller in the direction of the axis of rotation of the development roller, the non-development area not contributing to the development of the latent image on the image holding member, and wherein the magnetic plate extends so as to oppose the non-development area.

8. The developing device according to claim 1, wherein the development roller has a non-development area at the end portion of the development roller in the direction of the axis of rotation of the development roller, the non-development area not contributing to the development of the latent image on the image holding member, and wherein the magnetic plate extends so as to oppose the non-development area.

9. An image forming apparatus comprising:

an image holding member that holds a latent image, the image holding member holding a toner image when the latent image is developed;

a developing unit that develops the latent image on the image holding member with toner; and a transfer fixing unit that transfers the toner image held by the image holding member to a recording medium, and that fixes the toner image, wherein the developing unit includes a development roller that holds developer containing toner and carrier, rotates and transports the developer to a development area, and develops the latent image using the toner, the development area opposing the image holding member, a housing that has a first opening that opens towards the image holding member, wherein the housing holds the development roller so that the development area of the development roller is exposed from the first opening, the housing containing the developer therein, an airflow path that has a second opening that opens towards the image holding member at a location below the first opening, a blower that causes air in the airflow path to be sent in a direction in which the toner scattered between the housing and the image holding member is sucked from the second opening, and a magnetic plate that is disposed in the housing, the magnetic plate opposing an end portion of the development roller in a direction of an axis of rotation of the development roller and extending so as to surround the development roller in a direction of rotation of the development roller, wherein the housing has a suction hole, the suction hole being formed between an edge of the magnetic plate at a side of a lower edge of the first opening and the lower edge of the first opening, the suction hole being connected to the airflow path, the suction hole sucking the developer that has leaked out into the airflow path.

* * * * *